United States Patent [19]

Szarka

[11] Patent Number: 4,669,538

[45] Date of Patent: Jun. 2, 1987

[54] DOUBLE-GRIP THERMAL EXPANSION SCREEN HANGER AND RUNNING TOOL

[75] Inventor: David D. Szarka, Duncan, Okla.

[73] Assignee: Halliburton Company, Duncan, Okla.

[21] Appl. No.: 820,273

[22] Filed: Jan. 16, 1986

[51] Int. Cl.[4] ..... E21B 33/128; E21B 33/129; E21B 23/06

[52] U.S. Cl. ..... 166/120; 166/124; 166/134

[58] Field of Search ..... 166/120, 124, 242, 123, 166/181, 134, 132; 277/236

[56] References Cited

U.S. PATENT DOCUMENTS

| | | | |
|---|---|---|---|
| 2,120,982 | 6/1938 | Layne | 277/236 |
| 2,791,278 | 5/1957 | Clark | 277/236 |
| 3,163,225 | 12/1964 | Perkins | 166/123 |
| 3,342,268 | 9/1967 | Brown | 166/124 |
| 3,460,617 | 8/1969 | Brown et al. | 166/124 |
| 3,731,740 | 5/1973 | Douglas | 166/120 |
| 4,008,759 | 2/1977 | Blackwell | 166/120 |
| 4,151,875 | 5/1979 | Sullaway | 166/126 |
| 4,281,840 | 8/1981 | Harris | 277/117 |
| 4,438,933 | 3/1984 | Zimmerman | 277/9.5 |
| 4,441,721 | 4/1984 | Harris et al. | 277/26 |
| 4,487,258 | 12/1984 | Jackson et al. | 166/120 |

*Primary Examiner*—Stephen J. Novosad

*Assistant Examiner*—Bruce M. Kisliuk

*Attorney, Agent, or Firm*—James R. Duzan

[57] ABSTRACT

A double-grip screen hanger apparatus providing compensation for thermal expansion as a result of heat, such as is present in steam flood or steam injection wells. The screen hanger includes an inner mandrel adapted for attachment to a liner screen. A packer portion is disposed around the inner mandrel, and opposed upper and lower slip assemblies are positioned above and below the packer portion, respectively. The slip assemblies and packer portion are shearably attached to the inner mandrel. Setting of the slips and packer is accomplished by a hydraulic actuator and a running tool attached to the tool string. Downward force applied on the mandrel shears the shearing attachments, thus setting the slips and the packer portion. After setting, the slips locate the packer, and the mandrel is relatively free to longitudinally move within the packer and slips due to thermal expansion. The shearing attachment of the lower slip assembly is stronger than the other shearing attachments, and thus is not sheared during the setting operation. Sufficient thermal expansion of the inner mandrel will result in shearing this shearing attachment. The running tool is releasably attached to the screen hanger, and may be detached therefrom by right-hand rotation.

18 Claims, 6 Drawing Figures

DOUBLE-GRIP THERMAL EXPANSION SCREEN HANGER AND RUNNING TOOL

BACKGROUND OF THE INVENTION

1. Field of the Invention

This invention relates to screen hangers for use in supporting a gravel pack screen in a well bore, and more particularly, to a screen hanger adapted to compensate for thermal expansion as a result of heat such as is present in steam flood or steam injection wells.

2. Description of the Prior Art

Packers used for supporting liner screens adjacent a gravel packed well formation are known in the art. These packers often serve to act as hangers to support the screen as well as seal the well annulus above the screen. Typically, such packers are rigidly attached to the screen and utilize elastomeric seal elements, such as rubber.

Most previous packers known in the art are not suitable in high temperature situations such as occur in steam flood or steam injection wells. Once such packers are set, there is no provision made for compensating for the extreme changes in temperatures and the resultant thermal expansion of the components. The apparatus of the present invention solves this problem by utilizing a totally floating mandrel inside a packer portion. Once the packer has been set, and heat is applied in the well, the mandrel, which is the only portion of the apparatus connected to the liner screen, is free to expand or contract as conditions dictate.

One prior apparatus which provides thermal compensation is manufactured by Chancellor Oil Tools in Bakersville, Caif. This apparatus has a mandrel which may expand in a longitudinal direction and which is guided in part by slip supports sealed by O-rings thereon. The Chancellor apparatus has slips below the packer element unlike the present invention which utilizes slips above and below the packer to rigidly locate and restrain the packer in a set position.

Another problem with previous gravel packing apparatus in high temperature situations is that the elastomeric sealing members are not adequate. It is well known that elastomeric elements, such as rubber, harden and sometimes shrink when subjected to high temperatures. Thus, these materials are not suitable for sealing when high temperatures are present.

The apparatus of the present invention preferably utilizes a thermal seal element of a heat resistant material. Such materials include, but are not limited to, lead and thermoplastics. Lead is particularly good because it is inexpensive. The Chancellor apparatus also uses a lead seal, but because the seal is not restrained by upper and lower slips, it is possible that the seal could be undesirably extruded when pressure is applied thereto.

The apparatus of the present invention is designed to be made relatively inexpensively compared to most packers. The use of collet-type slips reduces the number of parts, as compared to previous packers.

One old method of packing a liner screen in a well having high temperatures consists of driving a lead seal into the well annulus around the liner to seal the annulus at the top of the liner after completion of the gravel packing operation. This system is unsatisfactory in that compensation for thermal expansion of the liner is not provided and requires an additional trip out of the well, unlike the present invention which needs just one trip.

Further, the lead seal of the previous method is not as securely set and located as with the present invention.

SUMMARY OF THE INVENTION

The double-grip screen hanger apparatus of the present invention comprises mandrel means engageable with a screen liner, packer means annularly disposed around the mandrel means for sealingly engaging a well bore when in a packer means set position; slip means for grippingly engaging the well bore when in a slip means set position and for substantially rigidly locating the packer means in the well bore, shear means for shearably attaching the packer means and slip means to the mandrel means, and setting means for setting the packer means and slip means in said setting positions, and thereby shearing the shear means for freeing the mandrel means to longitudinally expand within the packer means. Stop means are provided on the mandrel means for limiting downward longitudinal movement of the mandrel means with respect to the packer means.

The shear means includes expansion shear means for shearing as the mandrel means is subjected to thermal expansion.

The slip means are preferably double-grip slip means comprising a slip assembly disposed above the packer means and another slip assembly below the packer means. When set, the slip assemblies prevent any longitudinal movement of the packer means.

The packer means is also adapted for sealingly engaging an outer surface of the mandrel means and preferably comprises a thermally resistant seal element deformable into sealing engagement with an inner surface of the well bore and the mandrel means. The thermally resistant seal element, such as lead, insures adequate sealing engagement even when subjected to high temperatures.

Because of the shearing of the shear means, and the resultant floating ability of the mandrel means, thermal expansion compensation means are thus provided for compensating for thermal expansion of the mandrel means and of the liner screen therebelow caused by heat present in the well bore, such as in steam flood or steam injection wells.

The screen hanger means of the present invention is thus adapted to form part of a downhole tool assembly for use in a well bore which also comprises a liner including a liner screen attached to the screen hanger means and a running tool engaged with a screen hanger means and comprising hydraulic actuation means for actuating the packer means to the set position.

The hydraulic actuation means comprises body means defining a piston annulus therein, port means on the body means for providing fluid communication between a central opening of the running tool and the piston annulus, piston means slidably disposed in the piston annulus and adapted for engaging the packer means, and sleeve means slidably disposed in the body means. The sleeve means has a first position for closing the port means and a second position for opening the port means and is adapted for receiving plug means such as a ball or sealing plug pumped downwardly thereto. As the plug means is received by the sleeve means, pressure applied thereabove moves the sleeve means from the first position to the second position, thereby actuating the piston means for downward movement thereof. The downward movement of the piston means results in engagement with, and actuation of, the packer means and slip means to the set position.

An important object of the present invention is to provide a screen hanger having a floating mandrel therein adapted for compensating for thermal expansion caused by heat in the well bore.

Another object of the invention is to provide a downhole tool including a thermal expansion screen hanger attached to a liner screen and simultaneously running into a well bore with the liner screen, thus eliminating a second trip into the well bore for positioning a packer or other seal means.

A further object is to provide a screen hanger having packer means rigidly located by slip means.

Still another object of the invention is to provide an inexpensive and retrievable screen hanger apparatus which is hydraulically actuated.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
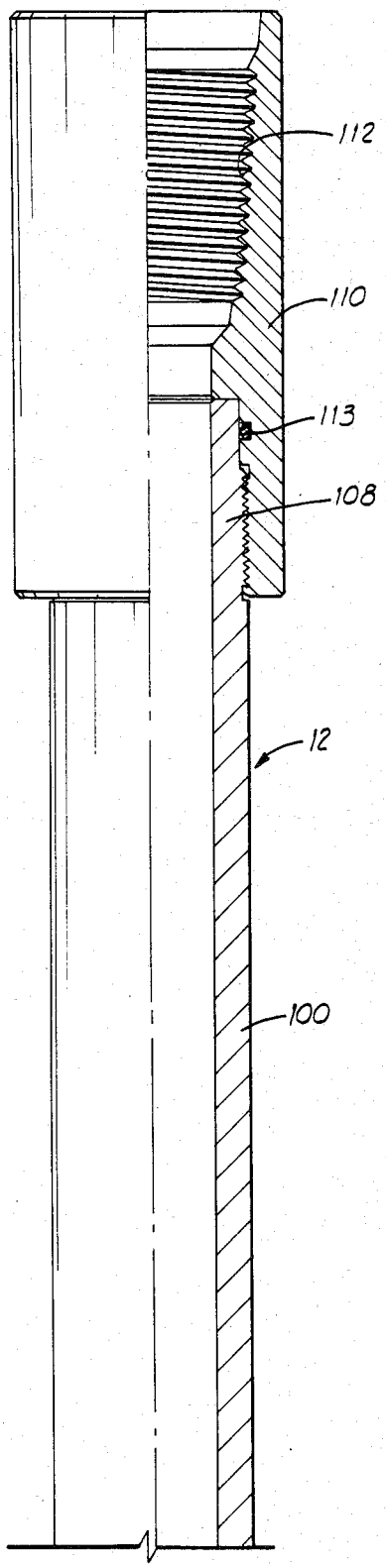
FIGS. 1A–1D illustrate the double-grip thermal expansion screen hanger of the present apparatus and a running tool having a hydraulic actuator for setting the packer.

Referring now to the drawings, and particularly FIGS. 1A–1D, the double-grip thermal expansion screen hanger of the present invention is shown and generally designated by the numeral 10. Screen hanger 10 is run into a well bore on a running tool 12.

Figure 1B:
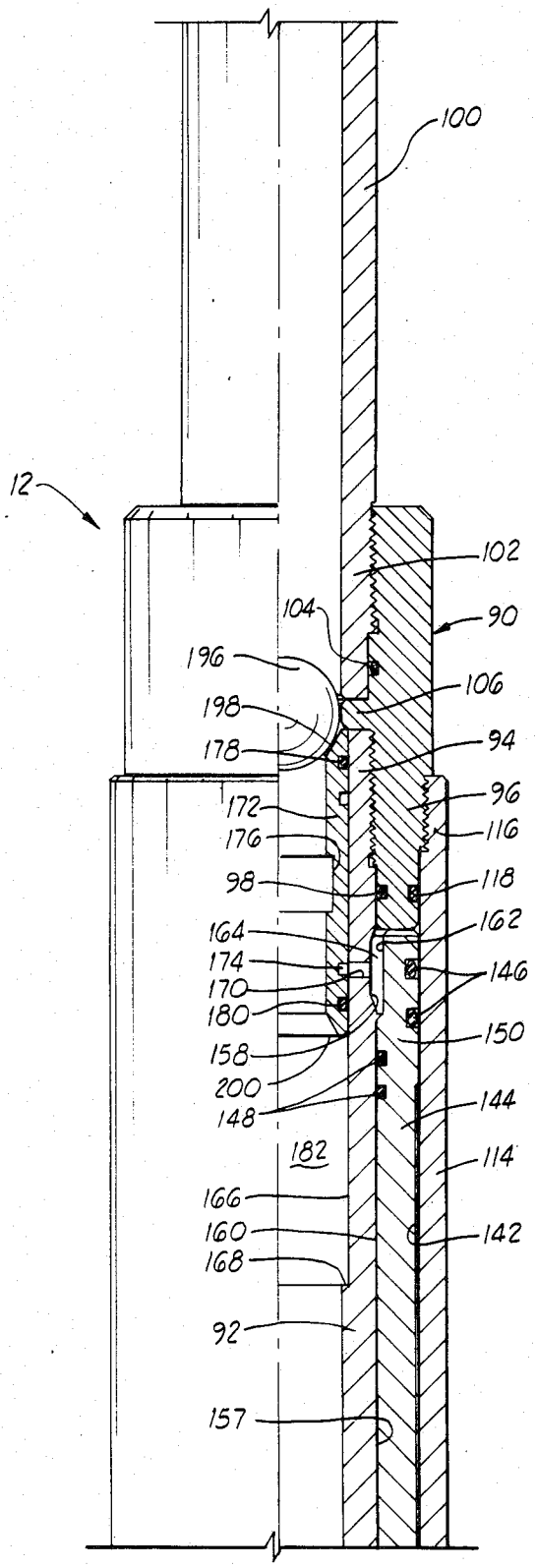
Figure 1C:
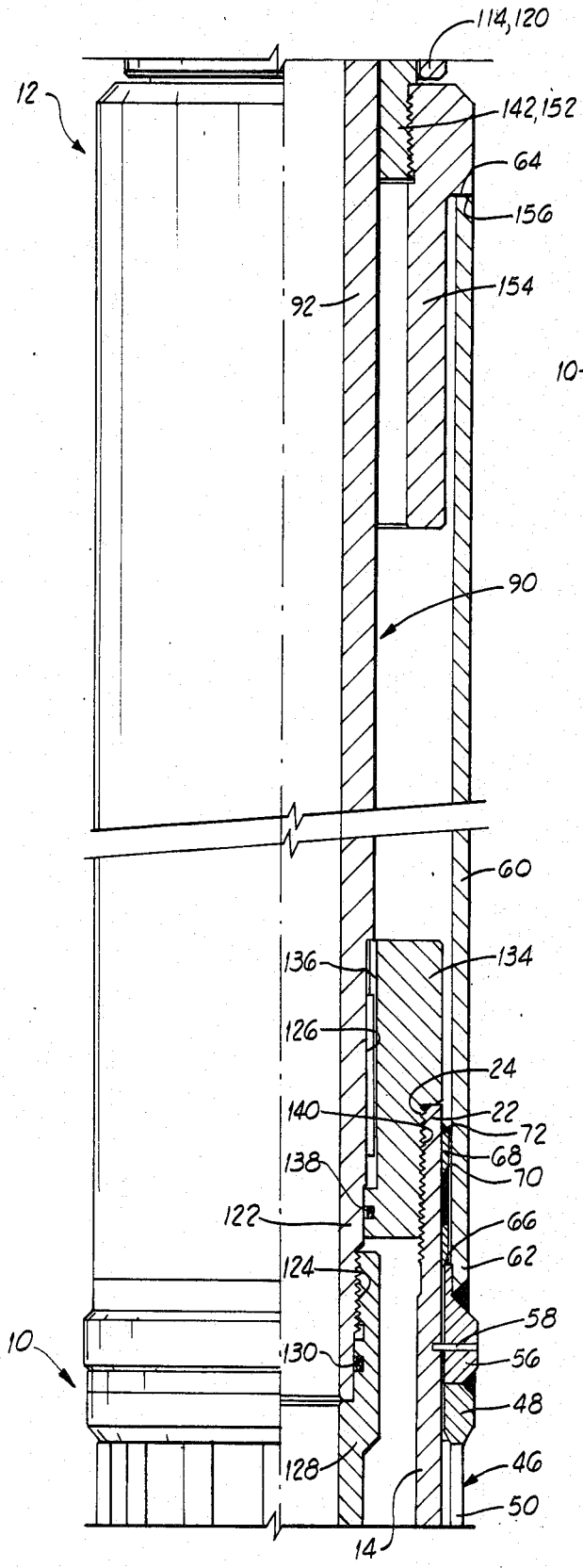
Figure 1D:
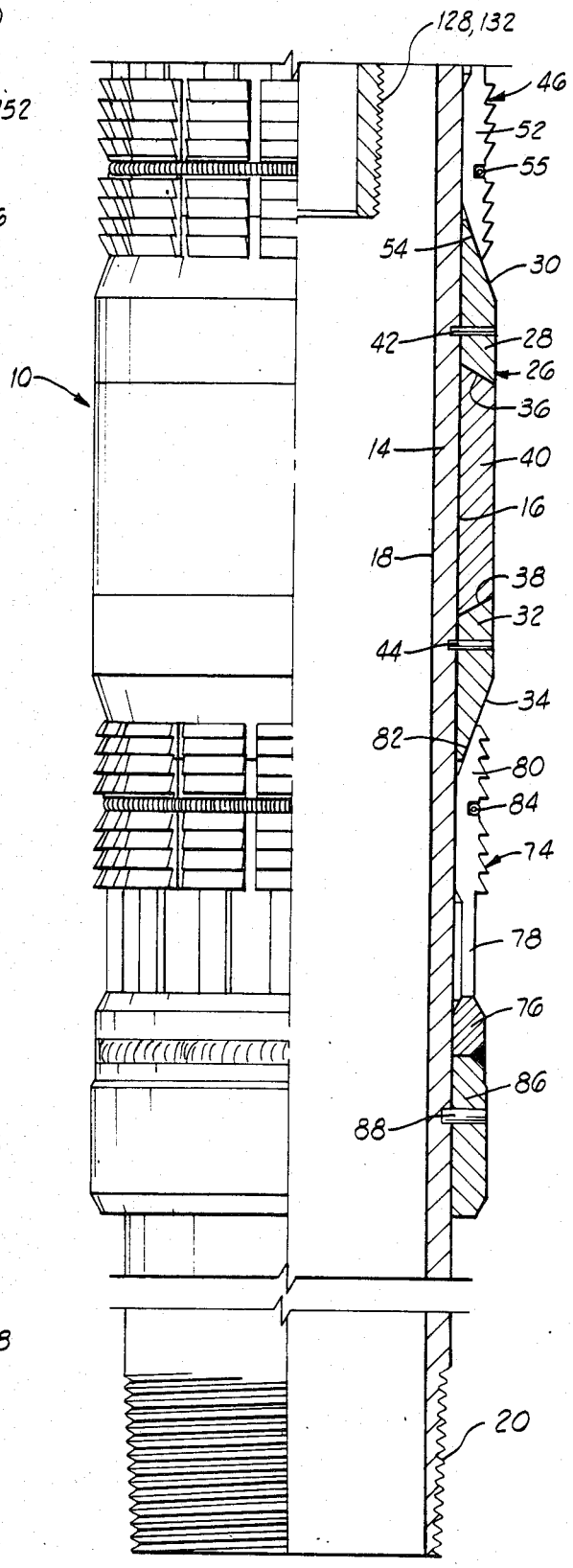

As shown in FIGS. 1C and 1D, screen hanger 10 includes mandrel means in the form of an inner mandrel 14 having an outer surface 16 of substantially constant diameter and defining a central opening 18 therethrough. Inner mandrel 14 has an externally threaded lower end 20 adapted for attachment to a liner screen of a kind known in the art. Inner mandrel 14 further has an upper end 22 having an internally threaded surface 24 comprising left-hand threads.

Annularly disposed around inner mandrel 14 at an intermediate location therealong is a packer portion 26. Packer portion 26 includes an upper support ring 28 having an upwardly facing wedge portion 30 and a lower support ring 32 having a downwardly facing wedge portion 34.

Upper support ring 28 has a lower tapered surface 36, and lower support ring 32 has an upper tapered surface 38 facing surface 36. Thus, outer surface 16 of inner mandrel 14, tapered surface 36 of upper support ring 28 and tapered surface 38 of lower support ring 32 define an outwardly facing annular recess having a substantially trapezoidal cross section. Filling this recess is a thermal seal element 40. Preferably, seal element 40 is made of lead or other thermally resistant, deformable material, such as thermoplastics. Other packer elements usable includes asbestos fibers impregnated with a thermoplastic and interwoven with Inconel wire. Two such packer elements are shown in U.S. Pat. Nos. 4,281,840 to Harris and 4,441,721 to Harris et al., assigned to the assignee of the present invention and are incorporated herein by reference.

First shear means are utilized to attach packer portion 26 to inner mandrel 14. In the preferred embodiment, the first shear means are characterized by a shear pin 42 which connects upper support ring 28 to inner mandrel 14 and another shear pin 44 which connects lower support ring 32 to the inner mandrel.

Positioned above packer portion 26 is an upper slip assembly 46 which includes an annular base portion 48 with a plurality of collet-type fingers 50 fixedly attached thereto and extending longitudinally downwardly therefrom. Each finger 50 has a gripping element or portion 52 fixedly attached to a lower end thereof. Gripping portion 52 has an inner tapered surface 54 which engages wedge 30. A band 55 encompasses gripping portions 52 for prevention of premature setting, although the strength of fingers 50 will usually prevent such setting.

Base portion 48 of upper slip assembly 46 is fixedly attached, as by welding, to an upper slip support 56. Second shear means are used to attach upper slip support 56 to inner mandrel 14 adjacent upper end 22 of the inner mandrel. Preferably, the second shear means is a shear pin 58.

Extending upwardly from upper slip support 56 is a setting sleeve 60 having a lower end 62 fixedly attached to upper slip support 56, as by welding, and an upwardly facing upper end 64.

Upper slip support 56 and setting sleeve 60 are adapted such that the upper slip support has an upwardly facing annular shoulder 66 adjacent inner mandrel 14. A stop ring 68 is positioned around upper end 22 of inner mandrel 14. Stop ring 68 defines a plurality of slots 70 therethrough, and is attached to inner mandrel 14 by welding through the slots and welding upper end 72 of the stop ring.

Positioned below packer portion 26 is a lower slip assembly 74, similar to upper slip assembly 46. Lower slip assembly 74 includes an annular base portion 76 having a plurality of collet-type fingers 78 extending longitudinally upwardly therefrom. Each collet finger 78 has a gripping portion 80 at an upper end thereof, and each gripping portion 80 has a tapered inner surface 82 engaging wedge 34. Another band 84 extends around gripping portions 80 to prevent premature setting of lower slip assembly 74. Base portion of lower slip assembly 74 is fixedly attached, as by welding, to a lower slip support 86.

In the preferred embodiment, upper slip support 56 and lower slip support 86 have a larger diameter than gripping portions 52 and 80 of the slips, respectively, so that the gripping portions will be prevented from contacting the well bore as screen hanger 10 is run into the well.

Third shear means are used to attach lower slip support 86 to inner mandrel 14, and the third shear means preferably require a greater force for shearing thereof than do the first and second shear means. In the preferred embodiment, the third shear means is characterized by a large shear pin 88. The shear strength of shear pin 88 is greater than that of shear pins 42, 44 or 58. The greater strength of shear pin 88 is important in the operation of the apparatus, as further described herein.

Referring now also to FIGS. 1A, 1B and 1C, running tool 12 is shown in detail. Running tool 12 includes body means characterized by a body 90 formed by a number of individual components. Body 90 includes a lower mandrel 92 having an upper end 94 threadingly engaged with a collar 96. A seal, such as O-ring 98, is provided between collar 96 and lower mandrel 92. An upper mandrel 100 has a lower end 102 threadingly engaged with collar 96, and another seal, such as O-ring 104, is positioned therebetween. An inwardly directed annular shoulder 106 is disposed between lower end 102 of upper mandrel 100 and upper end 94 of lower mandrel 92.

An upper end 108 of upper mandrel 100 is threadingly engaged with an adapter 110 which has an internally threaded surface 112 for attachment to an upper portion of a tool string. A seal, such as O-ring 113, is disposed between upper mandrel 100 and adapter 110. Upper mandrel 100, which has a smaller outside diameter than adapter 110 and collar 96, thus provides a pick-up and handling sub for running tool 12.

Body 90 further includes a cylinder 114 having an upper end 116 threadingly engaged with collar 96. A seal, such as O-ring 118, is provided between upper end 116 of cylinder 114 and collar 96. Cylinder 114 extends downwardly from collar 96, terminating in a free lower end 120.

A lower end 122 of lower mandrel 92 of body 90 has an externally threaded portion 124 and an externally splined portion 126. A lower adapter 128 is attached to threaded surface 124 and has a seal, such as O0ring 130, therebetween. Lower adapter 128 has an externally threaded lower end 132 which is adapted for attachment to a tail pipe and associated gravel pack tools, such as isolation packers and shifting tools, known in the art. In this way, these tools may be run below running tool 12 to permit a gravel packing operation on the liner screen after screen hanger 10 has been set.

A back-off nut 134 having an internally splined portion 136 is positioned around lower end 122 of lower mandrel 92 of body 90. A seal 138 is used to seal between nut 134 and lower mandrel 92. Back-off nut 134 has a threaded outer surface 140 comprising a left-hand thread which is threadingly engaged with left-hand threaded surface 24 of inner mandrel 14 of screen hanger 12. It will be seen, therefore, that back-off nut 134 provides a means for releasably attaching running tool 12 to screen hanger 10.

Lower mandrel 92 and cylinder 114 define an annular recess or piston annulus 142 therebetween. Piston means are slidingly disposed within annular recess 142 in the form of a setting piston 144 having outer piston seals 146 and inner piston seals 148 disposed on an upper end 150 thereof. A lower end 152 extends downwardly beyond lower end 120 of cylinder 114. Threadingly engaged to lower end 152 of setting piston 144 is a setting ring 154. Setting ring 154 has a downwardly facing shoulder 156 which faces, and is in contact with, upper end 64 of setting sleeve 60.

Lower mandrel 92 of body 90 has an outer surface 157 having a reduced diameter portion 158. Setting piston 144 has an inside surface 160 having an enlarged diameter portion 162 adjacent reduced diameter portion 158 of lower mandrel 92. Thus, an annulus 164 is defined therebetween.

Lower mandrel 92 has an inner surface 166 having an upwardly facing shoulder 168 at a lower end thereof. Port means, best characterized by a setting port 170, provides communication between a central opening of running tool 12 defined in part by inner surfaces 166 and annulus 164.

Slidingly disposed in inner surface 166 is an actuating sleeve 172. Initially, actuating sleeve 172 is attached to lower mandrel 92 by shear means, such as a shear pin 174. Shear pin 174 is preferably in the same plane as setting port 170. For illustration purposes in FIG. 1B, shear pin 174 is shown adjacent port 170. However, shear pin 174 and port 170 are actually angularly displaced from one another. Actuating sleeve 172 has an outer surface 176 with an upper seal 178 and a lower seal 180 thereon. It will be seen that upper seal 178 and lower seal 180 are disposed on opposite sides of setting port 170. Thus, in this initial position of actuating sleeve 172, setting port 170 is closed off, and fluid communication between annulus 164 and central opening 182 of running tool 12 is prevented.

OPERATION OF THE APPARATUS

Figure 2A:
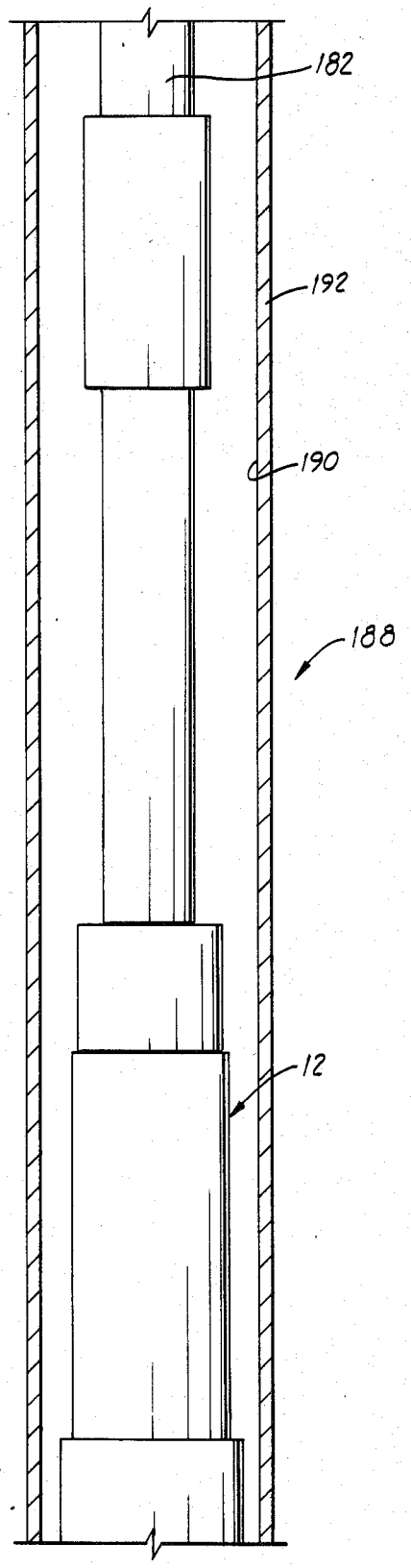
FIGS. 2A–2B show the screen hanger attached to a liner screen in a well bore with the running tool connected to a tool string.
Figure 2B:
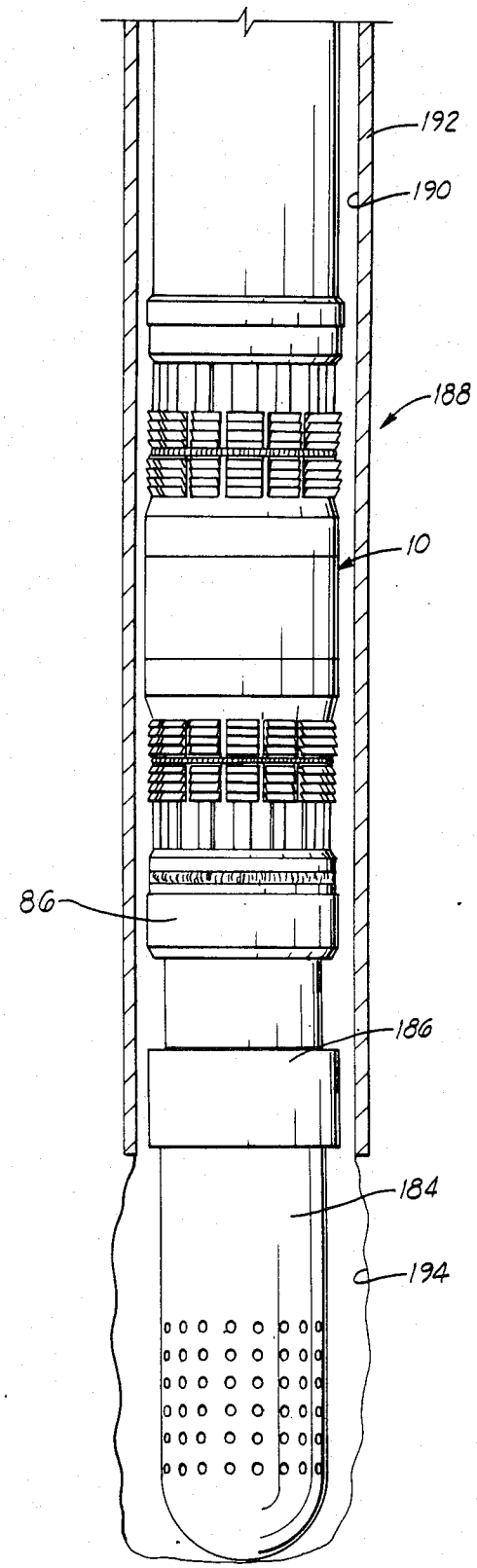

Referring now also to FIGS. 2A–2B, in the initial configuration, running tool 12 is attached to the lower end of an upper tool string portion 182. A liner including liner screen 184 is positioned below, and attached to, screen hanger 10. Normally, a ported collar 186 of a kind known in the art is positioned between screen hanger 10 and screen 184. Thus, a downhole tool assembly, generally designated by the numeral 188, is run into a well bore 190 defined by a well casing 192. Downhole tool 188 is positioned such that screen 184 is positioned adjacent a well formation 194 which is to be gravel packed in a manner known in the art.

Referring again to FIGS. 1A–1D, to set packer portion 26 and engage upper slip assembly 46 and lower slip assembly 74 with the well bore, plug means such as a ball 196 is dropped to engage a chamfered shoulder 198 on actuating sleeve 172. Although a ball 196 is illustrated, a sealing plug of a kind known in the art may also be used. Pressure is applied in the tool string to force ball 196 against chamfered shoulder 198. The resultant force shears shear pin 174 causing actuating sleeve 172 to move downwardly. Downward movement of actuating sleeve 172 is limited when lower surface 200 thereof contacts shoulder 168. At this time, setting port 170 is exposed, and annulus 164 is in communication with central opening 182 of running tool 12. Thus, sleeve means are provided for opening the port means. It will be seen that pressure is then applied to setting piston 144, causing it to move downwardly. Downward movement of setting piston 144 forces setting ring 154 to downwardly move setting sleeve 60.

As setting sleeve 60 is moved downwardly, shear pin 58 is sheared, so that upper slip assembly 46 is also moved downwardly. As upper slip assembly 46 is moved, tapered surface 54 of gripping portion 52 thereof slides along wedge 30 which forces gripping portion 52 outwardly. Band 55 is broken by this outward movement of gripping portion 52.

The downward force applied to wedge 30 results in shear pins 42 and 44 being sheared which in turn forces wedge 34 downwardly into engagement with tapered surface 82 of gripping portion 80 of lower slip assembly 74. Gripping portions 80 are thus forced outwardly, breaking band 84. Shear pin 88, being stronger than the other shear pins, is not sheared during this setting operation.

As setting sleeve 60 approaches its downwardmost position, gripping portion 52 of upper slip assembly 46 is engaged with well bore 190, as is gripping portion 80 of lower slip assembly 74. During this setting operation, upper packer support ring 28 and lower packer support ring 32 are moved relatively closer together which causes seal element 46 to be outwardly extruded into sealing engagement with well bore 190. Thus, setting means are provided for setting packer 26 and slip assemblies 46 and 74.

It will be seen, also, that seal element 40 is maintained in sealing contact with outer surface 16 of inner mandrel 14 of screen hanger 10, providing packer means for sealingly engaging the well bore and mandrel outer surface. Slip assemblies 46 and 74 provide double-grip, opposed slip means for substantially rigidly locating the packer means.

After screen hanger 10 is thus set so that packer portion 26 thereof is sealed against well bore 190 with upper and lower slip assemblies 46 and 74 grippingly engaging the well bore, running tool 12 may be detached from screen hanger 10. Right-hand rotation is applied to tool string 182, and it will be seen that back-off nut 134 is thus disengaged from threaded surface 24 of upper end 22 of inner mandrel 14. Once back-off nut 134 is totally disengaged from inner mandrel 14, tool string 182 and running tool 12 may be positioned for gravel packing operations. The components remaining are screen hanger 10, including setting sleeve 60, screen 184 and ported collar 186, if any.

After the setting operation described above, it will be clear to those skilled in the art, that inner mandrel 14 is totally free from upper slip assembly 46 and packer portion 26. The only attachment to lower slip assembly 74 is by shear pin 88. Prior to removing running tool 12, shear pin 88 may be sheared by lifting the running tool, and thus inner mandrel 14, with sufficient force to shear shear pin 88. This will result in increased loading on upper and lower slip assemblies 46 and 74 and on packer portion 26. However, this operation is not ordinarily necessary, in that the standard setting operation is adequate.

In steam flood or steam injection wells, screen hanger 10 and screen 184 are subjected to high temperatures, resulting in longitudinal expansion thereof. It will be seen that, because inner mandrel 14 is connected to slip assemblies 46 and 74 and packer portion 26 only by shear pin 88, assuming shear pin 88 has not already been sheared as described above, inner mandrel 14 is still relatively free to longitudinally expand within the slips and packer portion. Further, even if shear pin 88 has not previously been sheared, when screen 184 and inner mandrel 14 longitudinally thermally expand sufficiently, the expansion will cause shear pin 88 to be sheared. Upper slip assembly 46 and lower slip assembly 74 rigidly locate packer portion 26 in the well bore, and inner mandrel 14 is thus free to reciprocate therein due to expansion and contraction as temperature conditions dictate. The limit of this expansion occurs when ported collar 186 contacts lower slip support 86.

Seal element 40 provides a sliding seal with outer surface 16 of inner mandrel 14. Thus, inner mandrel 14 totally floats within the slips and packer to fully compensate for thermal expansion.

After releasing screen hanger 10 from running tool 12, a gravel packing operation of a kind known in the art may be carried out.

Should it become necessary to remove screen hanger 10 from the well bore, the screen hanger may be retrieved by latching onto setting sleeve 60 with a suitable fishing tool known in the art. An upper force may then pull upper slip assembly 46 out of engagement with wedge 30, providing gripping portion 52 is not excessively buried in well bore 190. Otherwise, upper slip assembly 46 and setting sleeve 160 may be milled over, and the remaining portion of screen hanger 10 removed from the well.

The construction and use of screen hanger 10 is designed to be relatively simple and inexpensive compared to most packing apparatus. In addition, the limited number of parts make screen hanger 10 relatively easy to assemble. Also, because screen hanger 10 is a part of the original tool string, it is not necessary to remove the tool string and make a second trip with a separate packer or to install a lead seal. Only the first trip is required.

It can be seen, therefore, that the thermal expansion screen hanger of the present invention is well adapted to carry out the objects and attain the ends and advantages mentioned, as well as those inherent therein. While a presently preferred embodiment of the invention has been described for the purposes of this disclosure, numerous changes in the construction and arrangement of parts can be made by those skilled in the art. All such changes are encompassed within the scope and spirit of this invention as defined by the appended claims.

What is claimed is:

1. A screen hanger apparatus comprising:

mandrel means engageable with a liner screen;

packer means annularly disposed around said mandrel means for sealingly engaging a well bore when in a packer means set position;

slip means for grippingly engaging said well bore when in a slip means set position and for substantially rigidly locating said packer means in said well bore;

shear means for shearably attaching said packer means and slip means to said mandrel means, said shear means including expansion shear means for shearing as said mandrel means is subjected to longitudinal thermal expansion; and setting means for setting said packer means and slip means in said set positions, and thereby shearing at least a portion of said shear means for freeing said mandrel means to longitudinally expand within said packer means.

2. The apparatus of claim 1 further comprising stop means on said mandrel means for limiting downward longitudinal movement of said mandrel means with respect to said packer means.

3. The apparatus of claim 1 further comprising actuation means releasably attached to said mandrel means for actuating said setting means.

4. The apparatus of claim 1 wherein said packer means is further adapted for sealingly engaging an outer surface of said mandrel means.

5. The apparatus of claim 4 wherein said packer means comprises a thermally resistant seal element deformable into sealing engagement with an inner surface of said well bore and said outer surface of said mandrel means.

6. The apparatus of claim 1 wherein said slip means comprises a slip assembly disposed above said packer means and another slip assembly disposed below said packer means.

7. A downhole tool for use in a well bore, said tool comprising:

a liner screen;

screen hanger means attached to said liner screen and comprising:

mandrel means;

packer means on said mandrel means for sealingly engaging said well bore when in a set position, said packer means including a lead packer element and said mandrel means has an outer surface in sealing contact with said packer element as said mandrel thermally expands in a longitudinal direction; and thermal expansion compensation means for compensating for thermal expansion of said liner screen and mandrel means caused by heat present in said well bore;

a running tool having a central opening therethrough and engaged with said screen hanger means and comprising hydraulic actuation means for actuating said packer means to said set position.

8. The apparatus of claim 7 further comprising a stop on said mandrel means for limiting downward movement of said mandrel means with respect to said packer means.

9. The apparatus of claim 7 further comprising a pair of slip means, said slip means being disposed on opposite sides of said packer means, each of said slip means having a set position for grippingly engaging said well bore and for lockingly locating said packer means therebetween.

10. The apparatus of claim 7 wherein said hydraulic actuation means comprises:

body means defining a piston annulus therein;

port means on said body means for providing fluid communication between said central opening of said running tool and said piston annulus;

piston means slidably disposed in said piston annulus and adapted for engaging said packer means; and sleeve means slidably disposed in said body means and having a first position for closing said port means and a second position for opening said port means, said sleeve means being adapted for receiving plug means pumped thereto;

whereby, as said plug means is received by said sleeve means, pressure applied thereabove moves said sleeve means from said first position to said second position, thereby actuating said piston means for downward movement thereof, and engaging and actuating said packer means to said set position.

11. The apparatus of claim 7 wherein:

said screen hanger means further comprises a left-hand threaded portion; and said running tool comprises a left-hand threaded portion engageable with said threaded portion of said screen hanger means, such that right-hand rotation of said running tool results in disengagement of said running tool from said screen hanger means.

12. A thermal expansion screen hanger apparatus for positioning a liner screen in a well bore, said apparatus comprising:

an inner mandrel having a lower end adapted for engagement with said liner screen and an upper end;

a packer portion positioned around an outer surface of said mandrel and having a set position wherein a seal element thereof is in sealing engagement with said mandrel outer surface and an inner surface of said well bore, said packer portion further having a running position;

first shear means for attaching said packer portion to said mandrel when said packer portion is in said running position thereof;

an upper slip positioned around said mandrel outer surface and above said packer portion, said upper slip having a set position grippingly engaging said well bore and a running position;

second shear means for attaching said upper slip to said mandrel when said upper slip is in said running position thereof;

a lower slip positioned around said mandrel outer surface and below said packer portion, said lower slip having a set position grippingly engaging said well bore and having a running position; and third shear means for attaching said lower slip to said mandrel means, said third shear means having a shear strength greater than a shear strength of said first and second shear means;

whereby, during a setting operation, a downward force relative to said mandrel is applied to said upper slip for shearing said first and second shear means and causing downward movement of said upper slip and said packer portion with respect to said mandrel, said downward movement actuating said upper slip and said packer portion from said running positions thereof to said set positions, and further actuating said lower slip from said running position thereof to said set position, said shearing of said first and second shear means releasing said mandrel for allowing longitudinal thermal expansion of said mandrel within said packer portion and slips, said thermal expansion causing shearing of said third shear means by said mandrel means when said thermal expansion exceeds a certain level.

13. The apparatus of claim 12 wherein:

said packer portion comprises upper and lower wedge portions; and each of said upper and lower slips comprises:

an annular slip support;

a plurality of fingers fixedly attached to said slip support and extending longitudinally therefrom; and a plurality of gripping elements, each gripping element being fixedly attached to one of said fingers and spaced from said slip support, said gripping elements engageable with a corresponding wedge portion for outward displacement into gripping engagement with said well bore.

14. The apparatus of claim 12 wherein:

said packer portion comprises:

an upper seal support above said seal element; and a lower seal support below said seal element;

said seal element is a thermally resistant seal outwardly deformable as said upper and lower seal supports are moved relatively closer together when said packer portion is moved to said set position.

15. The apparatus of claim 12 further comprising a stop ring on said mandrel for limiting downward movement of said mandrel after shearing of said shear means.

16. The apparatus of claim 12 further comprising a running tool detachably engaged with said mandrel upper end and having a hydraulic actuator therein comprising a piston, downwardly movable in response to pressure in said running tool, for actuating said upper slip.

17. The apparatus of claim 12 wherein:

said upper slip includes a setting sleeve attached thereto; and said piston has a downwardly facing shoulder engageable with an upper end of said setting sleeve.

18. The apparatus of claim 12 wherein said third shear means is shearable by upwardly pulling said mandrel with respect to said slips and said packer portion before said certain level of thermal expansion is exceeded.

* * * * *